US007896138B2

(12) United States Patent
Syrman et al.

(10) Patent No.: US 7,896,138 B2
(45) Date of Patent: Mar. 1, 2011

(54) ELEVATOR ARRANGEMENT

(75) Inventors: Timo Syrman, Hyvinkää (FI); Ari Kattainen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 176 days.

(21) Appl. No.: 12/289,472

(22) Filed: Oct. 28, 2008

(65) Prior Publication Data

US 2009/0120725 A1 May 14, 2009

Related U.S. Application Data

(63) Continuation of application No. PCT/FI2007/000102, filed on Apr. 20, 2007.

(30) Foreign Application Priority Data

Apr. 28, 2006 (FI) ..... 20060409

(51) Int. Cl.
*B66B 1/34* (2006.01)

(52) U.S. Cl. ..... 187/391; 187/289

(58) Field of Classification Search ..... 187/247, 187/277, 289, 290, 293, 296, 297, 391–393
See application file for complete search history.

(56) References Cited

U.S. PATENT DOCUMENTS 4,326,606 A * 4/1982 Kuzunuki et al. ..... 187/248
4,776,433 A 10/1988 Lagree et al.
5,407,028 A * 4/1995 Jamieson et al. ..... 187/288
6,173,814 B1 * 1/2001 Herkel et al. ..... 187/288
6,422,350 B1 * 7/2002 Erker ..... 187/277
7,353,916 B2 * 4/2008 Angst ..... 187/393
2006/0015274 A1 1/2006 Trandafir et al.
2006/0137941 A1 * 6/2006 Andrejak et al. ..... 187/293
2007/0187185 A1 * 8/2007 Abraham et al. ..... 187/288
2008/0230326 A1 * 9/2008 Tyni et al. ..... 187/393
2009/0133964 A1 * 5/2009 Ueda et al. ..... 187/254
2009/0277724 A1 * 11/2009 Thumm et al. ..... 187/393

FOREIGN PATENT DOCUMENTS

EP 1518811 A1 3/2005
GB 2201811 A 9/1988
GB 2255204 A 10/1992
JP 06329349 A 11/1994

* cited by examiner

*Primary Examiner*—Jonathan Salata
(74) *Attorney, Agent, or Firm*—Birch, Stewart, Kolasch & Birch, LLP

(57) ABSTRACT

The invention concerns an arrangement and a method for controlling the power supply of the load of an elevator system. The arrangement has at least a monitoring unit and at least one controllable power source. The controllable power source is connected between the load of an elevator system and the monitoring unit such that the power supply of the load of the elevator system can be controlled by means of a control signal transmitted to the controllable power source by the monitoring unit. The monitoring unit according to the invention contains at least one input for determining the status of at least one safety switch of the elevator system. On the basis of the status of the safety switch a control signal either having pulses or being in a static state is sent with the monitoring unit to at least one controllable power source.

20 Claims, 5 Drawing Sheets

ELEVATOR ARRANGEMENT

Figure 1:
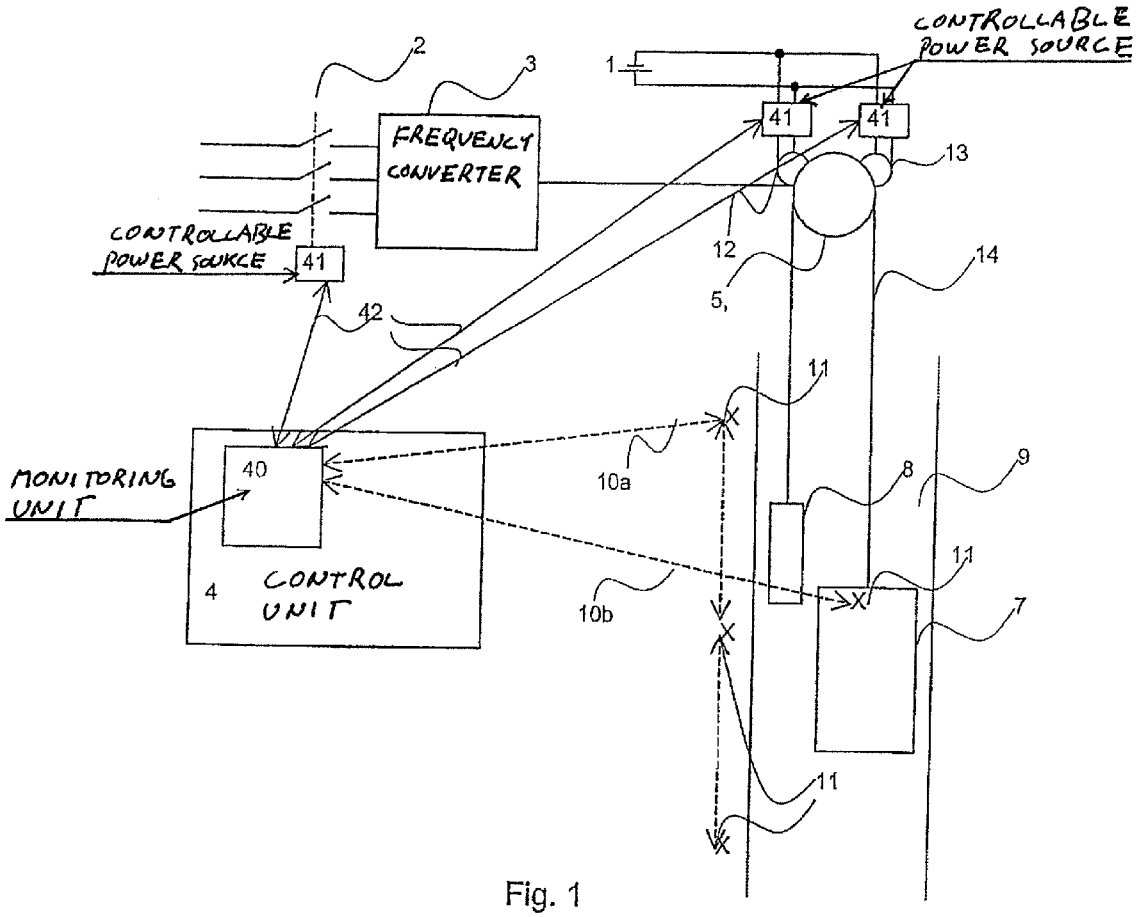

This application is a Continuation of copending PCT International Application No. PCT/FI2007/000102 filed on Apr. 20, 2007, which designated the United States, and on which priority is claimed under 35 U.S.C. §120. This application also claims priority under 35 U.S.C. §119(a) on Patent Application No(s). 20060409 filed in Finland on Apr. 28, 2006. The entire contents of each of the above documents is hereby incorporated by reference.

FIELD OF THE INVENTION

The present invention relates to an arrangement for controlling the power supply of a load of an elevator system, and a method of controlling the power supply of a load in an elevator system.

BACKGROUND OF THE INVENTION

In elevator systems, movement of the elevator car is permitted only when the doors of the elevator car and of the shaft are closed and the other conditions required to ensure the safety of passengers are fulfilled. In elevator systems in which the electric motor that moves the elevator car is controlled by means of a frequency converter according to the commands of the control unit of the elevator, safety is typically ensured with a safety circuit. The safety circuit can be implemented e.g. such that switches, which are connected to each other in series, are placed in the points that are essential from the standpoint of safety. The electricity supply of the elevator motor and opening of the holding brakes are only permitted if all the switches of the safety circuit are closed.

The status of the safety circuit typically controls the electricity supply appliance and the brakes of the elevator by means of electromechanical contactors such that when the safety circuit is open the contactors enabling the electricity supply of the motor and of the electromechanical brakes are also open. The contactors close only when the safety circuit closes, in which case the elevator car should not be able to move when the safety circuit is open.

The electromechanical contactors, by means of which the electricity supply of the electricity supply appliance and of the brakes of the elevator are controlled, are however susceptible to switching interference, which can lead to a dangerous situation. Furthermore the contactors are wearing devices, the operating life of which is limited, and noise is generated in conjunction with mechanical switchings, which reduces the passenger comfort of the elevator.

It is also possible that the current supply of the coil of the contactor is controlled by means of a processor via a controllable relay. In this case a dangerous situation can arise also e.g. as a consequence of a malfunction of the processor or from an electromagnetic pulse connected to the system, which can short-circuit the transistors of the system.

Purpose Of The Invention

The purpose of this invention is to disclose a reliable arrangement for controlling the electricity supply of loads in an elevator system, by means of which arrangement a safer elevator system, which is quieter in terms of noise level and which requires less servicing and replacement of components than prior art, is achieved.

Advantages Of The Invention

An elevator system utilizing the arrangement according to the invention is more operationally reliable and safer for passengers than prior art. By means of the arrangement according to the invention a malfunction of the processor and/or an electromagnetic pulse connected to the system, which short-circuits the transistors, disconnects the power supply from the loads to be controlled and a dangerous situation does not occur. Further by means of the invention it is also possible to detect a short-circuit of the load or the lack of a load. By means of the invention it is also possible to implement an elevator system, in which noise drawbacks caused by the contactors are less than prior art.

SUMMARY OF THE INVENTION

The arrangement of the invention for controlling the power supply of the loads of an elevator system is characterized by what is disclosed in the characterization part of claim 1. The method according to the invention for controlling the power supply of the loads in an elevator system is characterized by what is disclosed in the characterization part of claim 9.

Other embodiments of the invention are characterized by what is disclosed in the other claims. Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts.

The arrangement of the invention for controlling the power supply of a load of an elevator system comprises at least a monitoring unit and at least one controllable power source, which is fitted between the load of the elevator system and the monitoring unit such that the power supply of the load of the elevator system can be controlled by means of a control signal transmitted to the controllable power source by the monitoring unit. In accordance with the invention at least one controlled power source comprises means for transmitting power to the load when the power source receives a control signal comprised of pulses. The means are implemented such that when the power source receives a control signal in a static state power is not transmitted to the load.

In one embodiment of the invention the means for transmitting power to the load are arranged to transmit power only when the power source receives a control signal, which is comprised of a sequence of pulses possessing a certain pulse frequency. The monitoring unit can comprise means for programmed production of a control signal comprised of pulses, and the power supplied to the load can be controlled by means of the pulse ratio of the control signal. Further, the arrangement can comprise means for monitoring and/or regulating the power supply of the load.

In one embodiment of the invention the arrangement comprises a second monitoring unit, and each monitoring unit can comprise means for monitoring the operation of the other monitoring unit.

In the method according to the invention for controlling the power supply of a load in an elevator system, which comprises at least an elevator monitoring unit and at least one controllable power source, which is fitted between the load of the elevator system and the monitoring unit, the power supply of the load is controlled by means of a control signal transmitted to the controllable power source by the monitoring unit, and power is supplied to the load when the controllable power source receives a control signal comprised of pulses, and power is not supplied to the load when the controllable power source receives a control signal in a static state.

In one embodiment of the invention power is supplied to the load only when the control signal is composed of a sequence of pulses possessing a certain pulse frequency. The power supplied to the load can be controlled by means of the pulse ratio of the control signal, and the power can be regulated. According to the method it is also possible to monitor the power supplied to the load and/or the status of the load and to compare the status of the load to the status required by the control.

In one embodiment of the method according to the invention the status of the safety circuit is monitored with two monitoring units, and the monitoring units can be arranged to monitor the operation of each other.

LIST OF FIGURES

Figure 2:
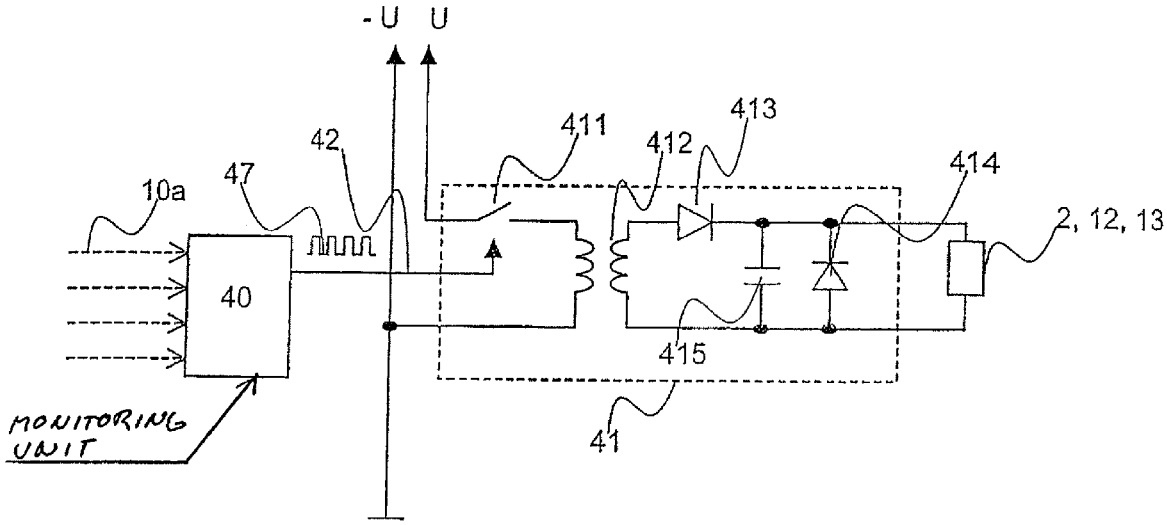
Figure 3:
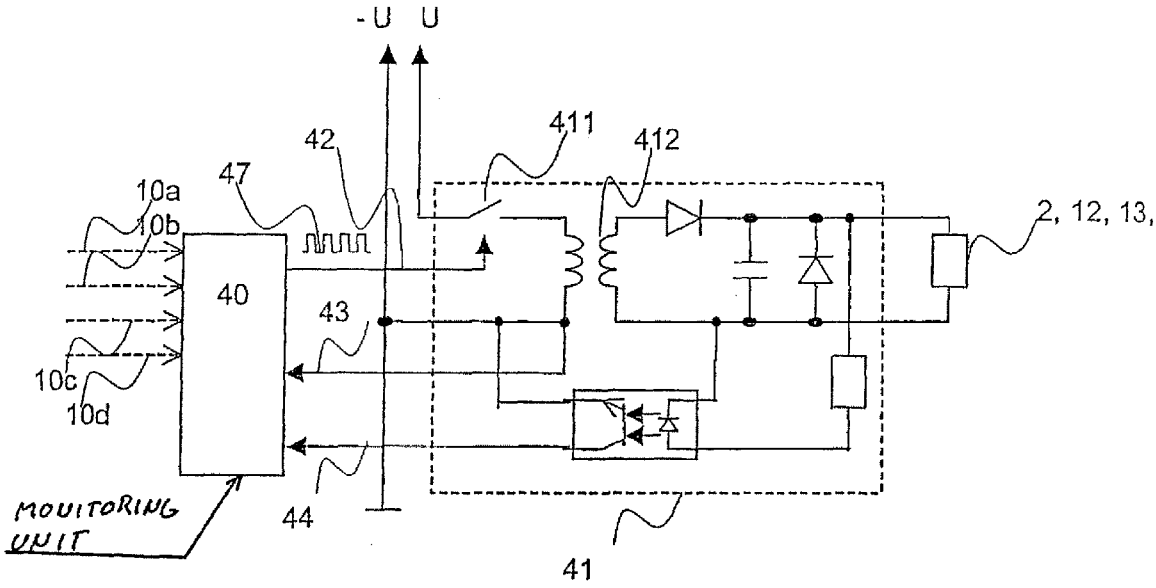
Figure 4:
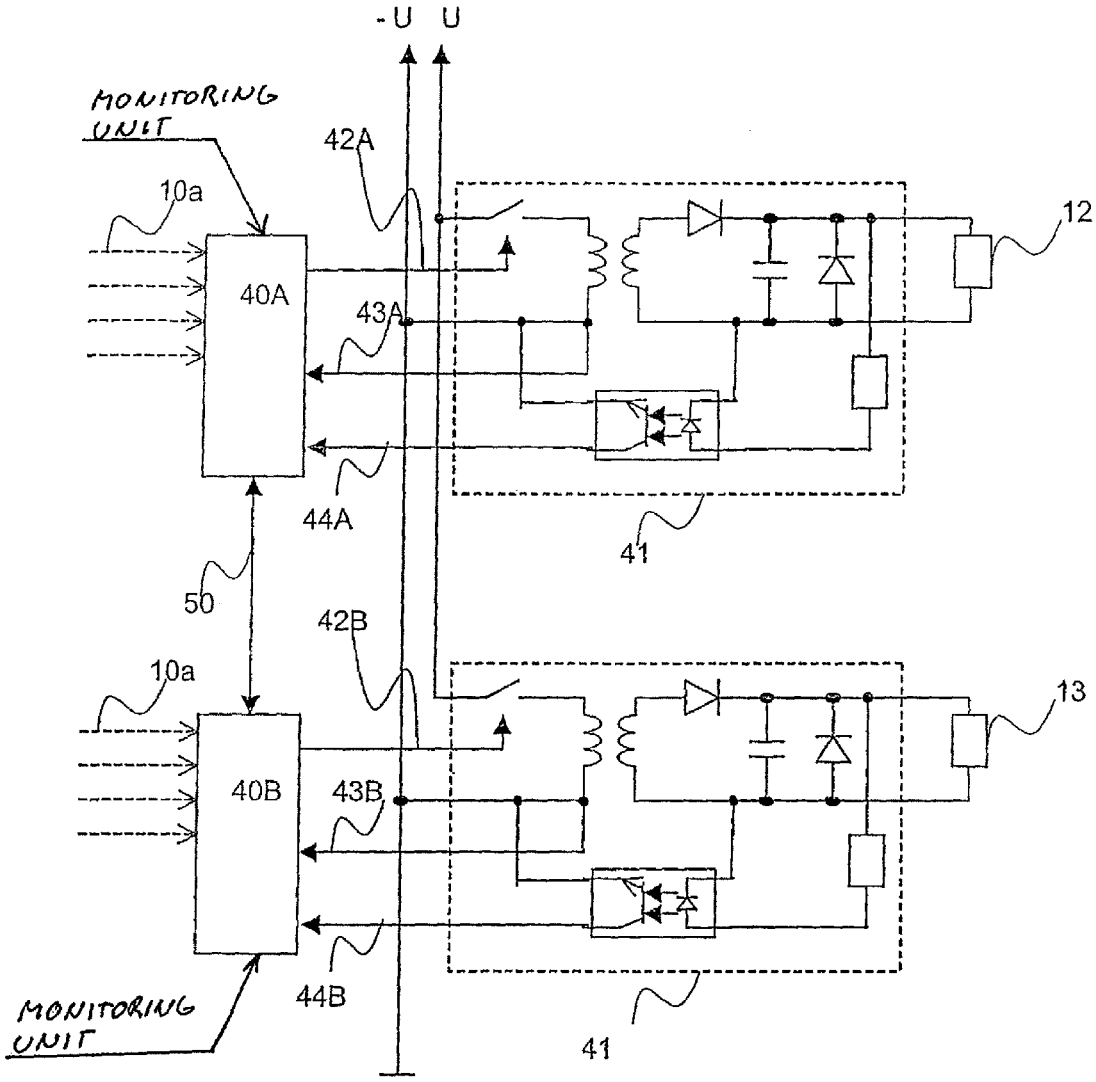
Figure 5A:
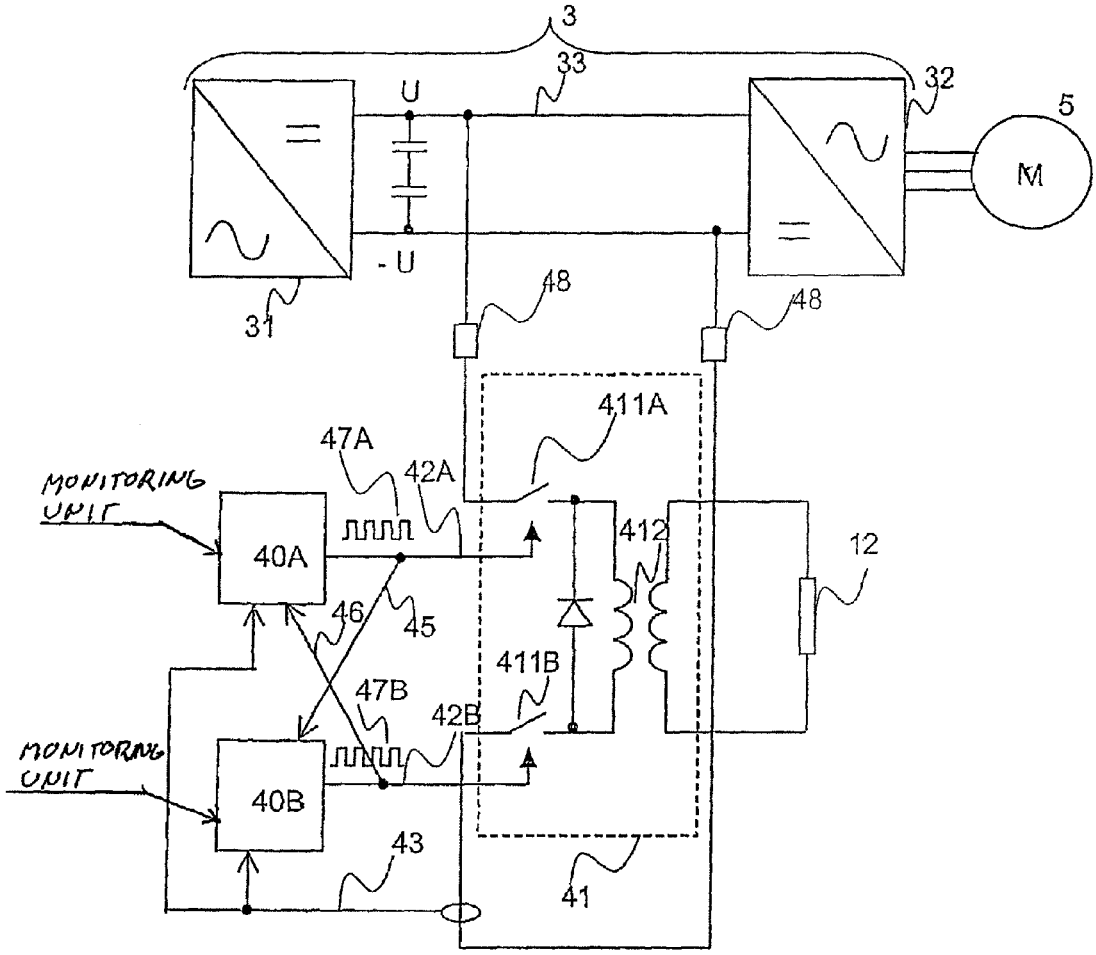
Figure 5B:
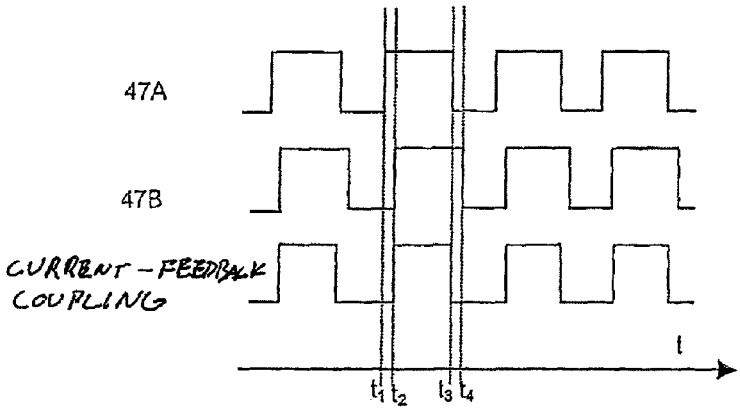

In the following, the invention will be described in more detail by the aid of a few examples of its embodiments with reference to the attached drawings, wherein FIG. 1 presents an elevator system, in which the arrangement according to the invention for controlling the power supply of loads is applied FIG. 2 presents a power control arrangement of an elevator arrangement according to the invention FIG. 3 presents a second power control arrangement of an elevator system according to the invention FIG. 4 presents a third power control arrangement of an elevator system according to the invention FIGS. 5*a* and 5*b* present a fourth power control arrangement of an elevator arrangement according to the invention.

DETAILED DESCRIPTION OF THE INVENTION

FIG. 1 presents an elevator system, in which the arrangement of the invention for controlling the power supply of the loads of an elevator system is applied. In the elevator system according to FIG. 1 the elevator car 7 and the counterweight 8 can be moved in the elevator shaft 9 by means of the elevator roping 14 by rotating the traction sheave 6 connected to or integrated into the elevator motor 5. The electricity supply and control of the elevator motor occur by means of a frequency converter 3. Between the frequency converter 3 and the electricity network is an elevator contactor 2. The elevator system further comprises a safety circuit 10, by means of which it is checked that, among other things, the doors of the shaft 9 and of the elevator car 7 are closed and that other requirements for safe elevator travel are fulfilled before the elevator starts moving. The safety circuit 10 can be implemented in different ways, although the criterion is that information about the closed status of each switch 11 is supplied to the monitoring unit 40, which is not enabled before the opening of the holding brakes 12, 13 or the closing of the contactor 2. In the solution according to FIG. 1 the safety switches 11 of the elevator shaft 9 are monitored by means of channel 10*a* and the safety switches of the elevator car by means of channel 10*b*, but there can be more monitoring channels than those presented in the figure, and it is also possible that other information than the information relating to the status of the switches 11 of the safety circuit can be conveyed in the channels. The information can also be conveyed in both directions. Channels 10*a* and 10*b* can be implemented e.g. by means of a serial communications channel, or it is also possible that the safety switches 11 are connected in series and an analog signal travels in channel 10*a* and/or 10*b*.

The operation of the elevator system is controlled and monitored in the control unit 4 of the elevator, by means of which, among other things, control commands are delivered to the frequency converter 3. With the monitoring unit 40 incorporated in the control unit of the elevator, it is ensured that the electromechanical brakes 12, 13 of the elevator do not open and that electricity is not supplied to the motor of the elevator if the status of the safety circuit 10 is not such that elevator travel is verified as safe. Monitoring unit means here a unit that has one or more inputs, on the basis of the information received from which the monitoring unit can transmit control commands onwards to the loads. Preferably the monitoring unit comprises at least one processor, and it is fitted to monitor at least the status of the safety circuit and to control the loads of the elevator system. The power supply of the holding brakes 12, 13 of the elevator and the contactor 2 is arranged via a controlled power source 41, the operation of which power source can be controlled by means of the monitoring unit 40 of the safety circuit. The monitoring unit 40 controls and monitors the operation of the power sources 41 via channels 42-44. It is also possible that the operational blocks of the control unit 4 are physically located separately from each other. The operation of the monitoring unit 40 and the controllable power source 41 is described in more detail in conjunction with FIGS. 2, 3 and 4.

FIG. 2 presents an arrangement according to the invention for controlling the power of a load. In the figure information about the status of the safety circuit is brought to the monitoring unit along channels 10*a*-10*d*. If the monitoring unit ascertains on the basis of the information received via channels 10*a*-10*d* that the elevator is in a state in which movement of the elevator car is permitted, it can transmit a control command along channel 42 to the controllable power source 41, behind which the load 2, 12 13 is connected. The load to be controlled can be e.g. the coil of the holding brake of the elevator, the relay controlling the contactor, a safety relay or another similar load, the operation of which is desired to be enabled with a command of the monitoring unit. By means of the arrangement of the invention for controlling the power supply, it is thus possible either to replace the whole contactor by means of a controllable power source 41 or the reliability of the contactor connection can be improved by arranging control of the contactor to take place according to the method of the invention. Further, one application of the arrangement according to the invention is use of the IGBT gate controllers of the motor drive as a power source. In this case a change in the state of the semiconductor switches can be prevented by disconnecting current from the controller producing control pulses, in which case the rotating field needed to achieve rotation of the motor is not generated. In this case the motor contactor can be dispensed with.

According to the invention the monitoring unit 40 enables power supply to the load by transmitting to the power source 41 a control signal 47, which is composed of a sequence of pulses. Preferably the control signal is implemented in the monitoring unit in a programmed manner such that the production of each individual pulse is contingent on faultless operation of the processor, and in which case also the frequency of the pulse sequence can be determined in a programmed manner. In this case as a result of a malfunction of the processor of the monitoring unit the power supply to the load is disconnected. When the pulses are produced in a programmed manner, it is also possible with the arrangement to control the amount of power supplied to the load by setting the pulse ratio to correspond to the power desired. It is also possible that the control signal is produced by using the pulse-like PWM output of the processor.

In the arrangement according to the invention the power supply to the load is disconnected in a normal situation by switching the control signal of the channel 42 off. Since the power source 41 is implemented in such a way that it allows power to the load only when the control signal is pulse-like, the power supply to the load is also disconnected in a situation in which the signal sent to the channel by the monitoring unit 42 has remained in a static on-state e.g. because of a fault, in which case the output signal is a direct-voltage signal without a time fluctuation. Preferably the controllable power source is implemented such that only a control signal 47 possessing the correct pulse frequency enables the power supply to the load. In this case any self-oscillation of the circuit does not switch the load on and a fault situation, in which as a result of a malfunction of the processor pulses are sent to the channel 42 with a smaller frequency than the normal status e.g. when the oscillator operates at only one-half of its normal frequency, disconnects the power supply of the load. With this it is possible to further improve the reliability of the arrangement. In the solution according to FIG. 2 the power source 41 is connected to a direct-voltage source, and the power allowed to the load 2, 12, 13 is controlled by alternately connecting and disconnecting direct voltage according to the control signal 47 with the switch 411, which can be e.g. an IGBT. It is also possible that the power source 41 receives its electricity supply from an alternating-voltage network. Owing to the transformer 412 of the power source 41, only connections occurring at the correct frequency permit power transmission through the power source 41 to the load, and malfunctions of the processor of the monitoring unit or any external disturbance connected to the channel 42 are not able to cause a dangerous situation.

The controlled power source 41 thus comprises means for transmitting power to the load 2, 12, 13 connected to it, when the power source 41 receives a control signal 47 comprised of pulses. The means are implemented such that power can be transmitted to the load only when the power source 41 receives a control signal 47 comprised of pulses, and the lack of a control signal or a control signal in a static state transmitted to the power source 41 disconnects the power supply to the load. Signals comprised of pulses means here a signal, the signal level of which fluctuates at intervals of at least 10 ms. The pulse frequency of the control signal that enables the transmission of power can vary e.g. between 50 . . . 400 Hz, but frequencies greater than this are possible. The precise time that the signal must be in a certain state for the state to be interpreted as static varies according to the construction of the power source 41, but a state lasting e.g. a second or a time longer than this can be interpreted as a static signal.

In the solution according to FIG. 2 the means for transmitting power when the power source receives a pulse-like control signal is implemented by means of a switch 411, a transformer 412, diodes 413, 414 and a capacitor 415, but the means can be implemented also with many other physical component arrangements. The circuit arrangement of FIG. 2 is thus only an example of a practical implementation of the controlled power source 41.

FIG. 3 presents a second arrangement according to the invention for controlling the power supply. The solution according to FIG. 3 comprises the same components and operates otherwise in the same manner as the solution presented in FIG. 2, but the figure contains two feedback channels 43 and 44 between the monitoring unit 40 and the power source 41. Of these the current supplied to the load is monitored with the channel 43, and via this the magnitude of the power, and with the channel 44 it is ensured that the status of the load 2, 12, 13 conforms to the control. In this way the reliability of the arrangement can be further increased. The transmission of the control signal 47 to the controllable power source 41 can be disconnected if the status of the load does not conform to the control, because in this case it can be deduced whether the controllable power source 41, its power supply or the load itself is faulty. By means of the feedback coupling it is thus possible e.g. to detect a short-circuit of the load and to prevent the supply of power to a load that is short-circuited. It is also possible that the arrangement comprises only one feedback channel 43 or 44. Since it is possible by means of the feedback couplings to monitor the power supplied to the load, which can further be controlled by means of the pulse ratio of the control signal 47, the arrangement presented enables also precise regulation of the power of the load.

In the solution according to FIG. 4 the reliability and fault tolerance of the control of the power supply is further improved by adding to the arrangement a second monitoring unit 40B, to which the same safety circuit information 10*a* . . . 10*d* can be supplied as to the first monitoring unit 40A. In addition to the fact that both monitoring units control the load taking into account the status of the safety circuit, both the monitoring units 40A and 40B can comprise means for monitoring the operation of the monitoring unit belonging to the arrangement of the other. In this case the monitoring units 40A and 40B can supervise the operation of each other, which in FIG. 4 is presented as occurring via channel 50. In this case when one of the monitoring units becomes faulty the other monitoring unit detects the fault, and this monitoring unit can switch the controlled loads off. In the solution according to FIG. 4 both of the monitoring units monitor the status of their own loads with the channels 44A, 44B, but it is also possible that the processors of the monitoring units monitor the loads of each other. The feedback couplings 44A, 44B presented in FIG. 4 can be e.g. cross-connected between the processors of the monitoring units, or another two separate feedback couplings can be arranged in the circuit, in which case both of the processors can monitor the other's load in addition to their own loads and to the operation of the other processor. With the solution according to FIG. 4 the power supply of e.g. the holding brakes can be controlled such that each of the holding brakes 12, 13 is supplied by means of its own power source 41.

It is also possible that the same load is controlled with the two monitoring units 40A, 40B, in which case extremely great operating reliability is achieved. This can be implemented e.g. such that the actual loading is behind two relays connected in series, and the power supply of both relays is arranged via a separate controllable power source 41. Further, it is possible that the power supply of the load is arranged to take place via one controllable power source 41, which power source is controlled by two processors. One arrangement of this type is presented in FIGS. 5*a* and 5*b*.

In the solution according to FIG. 5*a* the power to be transmitted to the load 12 is received from the direct-voltage intermediate circuit 33 of the transformer 3 supplying the elevator motor 5. The rectifier 31 can here be e.g. a diode bridge or a four quadrant converter, the inverter 32 is preferably a four quadrant converter, by means of which power can be transmitted both from the intermediate circuit towards the motor and vice versa. The controllable power source 41 supplying the load 12 is controlled with the processors of the two monitoring units 40A and 40B. The monitoring units 40A and 40B monitor the control signals 47A and 47B transmitted to each other's power source 41 via the channels 45 and 46, as well as the current of the power source via the feedback channel 43. By means of the current feedback coupling 43 it is possible to monitor the condition of the switches 411A and 411B and their gate controllers. If one of the units 40A, 40B detects that the control signal 47B, 47A and the current feedback information 43 of the other unit 40B, 40A do not correspond to the desired sequence, the processor of the monitoring unit can independently disconnect the pulsing enabling the power supply of the load.

The cross-monitoring between the processors of the monitoring units 40A and 40B can operate e.g. in the manner illustrated in FIG. 5*b*. The unit 40A switches the control signal 47A to the on-state only at the moment when it is verified that the control 47B and the current-feedback coupling 43 indicate a zero status. The processor of the unit 40B switches the control signal 47B on at the moment $t_2$ after verifying before connection that the current-feedback coupling 43 indicates zero and that the unit 40A has succeeded in disconnecting the current with the previous pulse. If it is desired to supply power to the load and the statuses of the feedback couplings correspond to the desired sequence, the units 40A and 40B switch the control signals according to FIG. 5*b* such that the signal 47A changes its status at the moments $t_1$ and $t_3$, the signal 47B changes its status at the moments $t_2$ and $t_4$, in which case the connection between the voltage source and the power source 41 is open only when both the control signals 47A, 47B are in the on-state, in other words during the time period $t_2$-$t_3$. In the solution according to FIG. 5*a* this corresponds also to the time when current-feedback information deviating from zero is received from the channel 43 when it is operating without disturbance.

The load 12 shown in FIG. 5*a* can be e.g. the coil of one holding brake, or the loading can also be the coils of both holding brakes. It is also possible that the power source does not contain a transformer at all, but instead the coil of the brake is connected directly between the switches 411A and 411B, in which case the current of the brake is directly controlled with the two monitoring units 40A and 40B. In this case however each brake coil needs its own pair of switches in order to ensure safe operation.

When the intermediate circuit 33 of the frequency converter 3 is used as the voltage source of the power source 41, the voltage of the intermediate circuit 33, the resistance of the power source 41 or of the coil of the brake, and the fuses 48 are preferably dimensioned such that if both the IGBTs 411A and 411B are simultaneously damaged, the fuses 48 disconnect the current in a short time.

For the sake of simplicity, in FIGS. 2-4 only one power source 41 is shown in connection with each monitoring unit of the safety circuit. A plurality of controllable power sources can however be connected to the monitoring unit of one safety circuit, and the quantity of possible power sources connected depends on the quantity of the output channels of the processors of the monitoring units.

In the above examples the operation of the controlled power source 41 and the monitoring unit 40 controlling it is described with reference to the loads 2, 12, 13 controlled according to the unit 40 monitoring the status of the safety circuit 10 and according to the status of the safety circuit. The arrangement for controlling a load according to the invention is however, by means of a controller enabling the operation of a controlled power source and a power source, applicable also to other loads of the elevator system, for which it is desired to enable an electricity supply safely and reliably. It can be conceived, for example, that a similar arrangement could be applied between the frequency converter unit and the timing relay of the brakes.

The inventive concept also comprises a method for controlling the power supply of loads in an elevator system, which elevator system comprises at least a monitoring unit 40 and a controllable power source 41, which is fitted between the load 2, 12, 13 of the elevator system and the monitoring unit 40, and according to which method the power supply of the load 2, 12, 13 of the elevator system is controlled by means of a control signal transmitted to the controllable power source 41 by the monitoring unit 40, such that power is only supplied to the load 2, 12, 13 when the monitoring unit 40 transmits to the controllable power source 41 a control signal 47, which is comprised of control pulses. Power is not supplied to the load when the controllable power source receives a control signal in a static state, in which case e.g. as a result of a static signal caused by a fault in the processor the power supply to the load is disconnected. In a normal operating situation the power supply of the load is prevented by keeping the output for channel 42 of the processor of the monitoring unit at zero.

In the method according to the invention the status of the safety circuit can be monitored with a monitoring unit, and the power supply of the loads enabled depending on the status of the safety circuit. In one embodiment of the method according to the invention the status of the safety circuit is monitored with two monitoring units, and the monitoring units can be arranged to monitor each other's operation.

In one embodiment of the invention power is supplied to the load only when the control signal 47 is composed of a sequence of pulses possessing a certain pulse frequency, in which case e.g. connections of external interference fields to the system do not cause a dangerous situation. The pulse frequency of the control signal can be selected such that with the selected frequency there are as few sources of interference as possible. The power supplied to the load can be controlled by means of the pulse ratio of the control signal. According to the method it is also possible to monitor the power supplied to the load and/or the status of the load and to compare the status of the load to the status required by the control. When feedback information about the status of the load is received, the power supplied to the load can be regulated also precisely. In addition, by means of the feedback coupling it is possible to detect whether the power supply of the load is on when according to the control signal it should be, and whether the power supplied to the load is at the correct value.

The invention is not limited solely to the embodiments described above, but instead many variations are possible within the scope of the inventive concept defined by the claims below.

REFERENCES OF THE FIGURES

1 Direct-voltage supply
2 Contactor
3 Frequency converter
4 Control unit
5 Elevator motor
6 Traction sheave
7 Elevator car
8 Counterweight
9 Elevator shaft
10 Safety circuit
10*a, b, c* Monitoring channel of safety circuit
11 Switch of safety circuit
12 Holding brake
13 Holding brake
14 Elevator roping
40 Monitoring unit
(40A) First monitoring unit
(40B) Second monitoring unit
41 Controllable power source

411 Switch, e.g. IGBT
412 Transformer
413, 414 Diode
415 Capacitor
42 Control commands from monitoring unit to power source
43 Monitoring of current of load
44 Monitoring of status of load
47 45, 46 Monitoring channel control signal of control commands
48 Fuse

The invention claimed is:

1. Arrangement for controlling a power supply of a load of an elevator system, which arrangement comprises at least a monitoring unit and at least one controllable power source, which controllable power source is connected between the load of the elevator system and the monitoring unit such that the power supply of the load of the elevator system is adapted to allow power to be fed to the load only when the power supply is controlled with pulses and to be controlled by means of a control signal transmitted to the controllable power source by the monitoring unit, wherein the monitoring unit contains at least one input for determining the status of a safety switch of the elevator system and in that the monitoring unit is adapted to send to the at least one controllable power source on the basis of the status of the safety switch only a control signal comprised of a series of pulses.

2. Arrangement according to claim 1, wherein the load referred to is the coil of a holding brake of an elevator.

3. Arrangement according to claim 1, wherein the monitoring unit contains an input for a first channel for monitoring safety switches of the elevator shaft and an input for a second channel for monitoring safety switches of the elevator car.

4. Arrangement according to claim 1, wherein the means for transmitting power to the load are adapted to transmit power only when the power source receives the control signal, which is comprised of a sequence of pulses possessing a certain pulse frequency.

5. Arrangement according to claim 1, wherein the monitoring unit comprises means for producing the control signal comprised of pulses in a programmed manner.

6. Arrangement according to claim 5, wherein the power supplied to the load is controlled by means of the pulse ratio of the control signal.

7. Arrangement according to claim 1, wherein the arrangement comprises means for monitoring the power supply of the load.

8. Arrangement according to claim 1, wherein the arrangement comprises means for regulating the power of the load.

9. Arrangement according to claim 1, wherein the arrangement further comprises a second monitoring unit.

10. Arrangement according to claim 9, wherein the monitoring units comprise means for monitoring operation of the other monitoring unit.

11. Method for controlling the power supply of at least one load in an elevator system, which elevator system comprises at least a monitoring unit and at least one controllable power source, which controllable power source is connected between the at least one load of the elevator system and the monitoring unit and the power supply of the load of the elevator system is adapted to allow power to be fed to the load only when the power supply is controlled with pulses, according to which method a power supply of the at least one load of the elevator system is adapted to be controlled by means of a control signal transmitted to the controllable power source by the monitoring unit, comprising:

determining with the monitoring unit the status of at least one safety switch of the elevator system sending from the monitoring unit to the at least one controllable power source, on the basis of the status of the safety switch, only a control signal comprised of a series of pulses for supplying power to the at least one load.

12. Method according to claim 11, further comprising:

supplying power to the load only when the control signal is composed of a sequence of pulses possessing a specific pulse frequency.

13. Method according to claim 11, further comprising:

controlling the power supplied to the load by means of the pulse ratio of the control signal.

14. Method according to claim 11, further comprising:

monitoring the the power supplied to the load.

15. Method according to claim 11, further comprising:

monitoring the status of the load, and comparing a status of the load to a status required by the control.

16. Method according to claim 15, further comprising regulating the power supplied to the load.

17. Method according to claim 11, further comprising monitoring the status of the safety circuit with two monitoring units.

18. Method according to claim 17, wherein the monitoring units are adapted to monitor the operation of each other.

19. Arrangement according to claim 2, wherein the monitoring unit contains an input for a first channel for monitoring safety switches of the elevator shaft and an input for a second channel for monitoring safety switches of the elevator car.

20. Arrangement according to claim 2, wherein the means for transmitting power to the load are arranged to transmit power only when the power source receives a control signal, which is comprised of a sequence of pulses possessing a specific pulse frequency.

* * * * *